US007347619B2

(12) United States Patent
Lee

(10) Patent No.: US 7,347,619 B2
(45) Date of Patent: Mar. 25, 2008

(54) WATCH ASSEMBLY HAVING A DIAL INTEGRALLY FORMED IN THE WATCH-GLASS

(76) Inventor: Jong-Chan Lee, 12-46, Gonghang-dong, Gangseo-gu, Seoul (KR)

( * ) Notice: Subject to any disclaimer, the term of this patent is extended or adjusted under 35 U.S.C. 154(b) by 96 days.

(21) Appl. No.: 11/371,422

(22) Filed: Mar. 9, 2006

(65) Prior Publication Data

US 2006/0256666 A1 Nov. 16, 2006

(30) Foreign Application Priority Data

May 14, 2005 (KR) ..... 10-2005-0040370

(51) Int. Cl.
*G04B 19/00* (2006.01)

(52) U.S. Cl. ..... 368/296; 368/223

(58) Field of Classification Search ..... 368/296, 368/223, 228, 232, 234
See application file for complete search history.

(56) References Cited

U.S. PATENT DOCUMENTS

| | | | | |
|---|---|---|---|---|
| 3,653,202 | A * | 4/1972 | Calame | 368/233 |
| 3,785,143 | A * | 1/1974 | Fujimori | 368/296 |
| 4,488,818 | A * | 12/1984 | Saurer et al. | 368/71 |
| 4,702,612 | A * | 10/1987 | Finger | 368/10 |
| 2006/0039244 | A1 * | 2/2006 | Gyger et al. | 368/296 |

* cited by examiner

*Primary Examiner*—Gary F. Paumen
(74) *Attorney, Agent, or Firm*—Alston & Bird LLP

(57) ABSTRACT

A watch assembly includes a case, a movement provided at an inner side of the case, hands coupled to the movement for indicating hours, minutes, and seconds, and a watch-glass provided at the case, the watch-glass having a dial so that the hands indicate a character thereon to thereby display the time. The watch assembly provides the dial which is integrally provided at the watch-glass, and various designs including photographic portraits, natural photographs, artistic photographs, sketches, and the like or characters are displayed on the dial, thereby embodying an appearance having a refined design.

34 Claims, 8 Drawing Sheets

WATCH ASSEMBLY HAVING A DIAL INTEGRALLY FORMED IN THE WATCH-GLASS

CROSS-REFERENCE TO RELATED APPLICATION

This application claims priority to and the benefit of Korean Patent Application No. 10-2005-0040370 filed in the Korean Intellectual Property Office on May 14, 2005, the entire content of which is incorporated herein by reference.

BACKGROUND OF THE INVENTION

1. Field of the Invention

The present invention relates to a watch assembly, and more particularly, to a watch assembly that has a dial integrally formed in a watch-glass and that displays a picture or letter thereon, thereby embodying a refined appearance in design.

2. Description of the Related Art

Generally, in a watch assembly according to a conventional art, the dial representing time is arranged at a portion under hands.

That is, as described in FIG. 1, the watch assembly comprises a case 1, a movement 3 provided at an inner side of the case 1, hands 5 coupled to the movement 3, for indicating hours, minutes, and seconds, a dial 4 for covering the movement 3 and having characters representing time, and a watch-glass 6 provided at the case 1 for covering the case 1.

Therefore, while the movement 3 is driving, the hands 5 rotate at a predetermined speed so as to indicate characters representing time on the dial 4.

However, in the conventional watch assembly, since the dial is placed below the hands, it is covered by the hands.

Therefore, the function of the dial is restricted to display of the characters representing the time thereon. Thus, it is difficult to display various designs on the dial or watch-glass.

SUMMARY OF THE INVENTION

The present invention has been made in an effort to solve the above-described problems of the conventional art.

It is an objective of the present invention to provide a watch assembly with the dial integrally provided at the watch-glass, and various designs including photographic portraits, natural photographs, artistic photographs, sketches, and the like or characters are displayed on the dial, thereby embodying an appearance of a refined design.

It is another objective of the present invention to provide a watch assembly that can display the designs or characters on the dial by various printing processes or manufacturing processes.

To achieve the above objectives, the present invention provides a watch assembly including a case; a movement provided at an inner side of the case; hands coupled to the movement for indicating hours, minutes, and seconds; and a watch-glass provided at the case, the watch-glass having a dial so that a hand indicates a letter to thereby display the time.

DETAILED DESCRIPTION OF THE PREFERRED EMBODIMENTS

Figure 1:
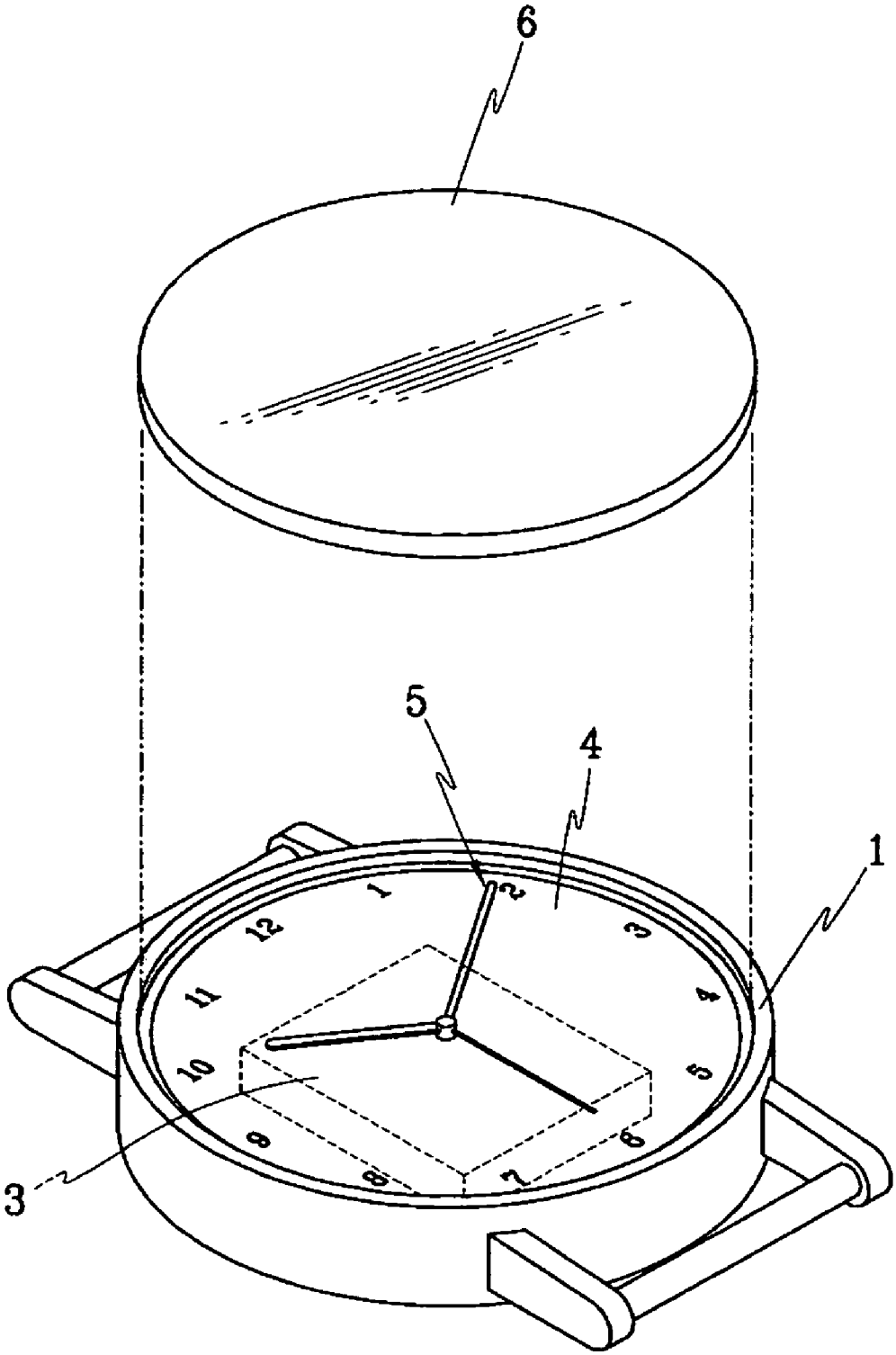
FIG. 1 is a partial perspective view of a watch assembly according to a conventional art.
Figure 2:
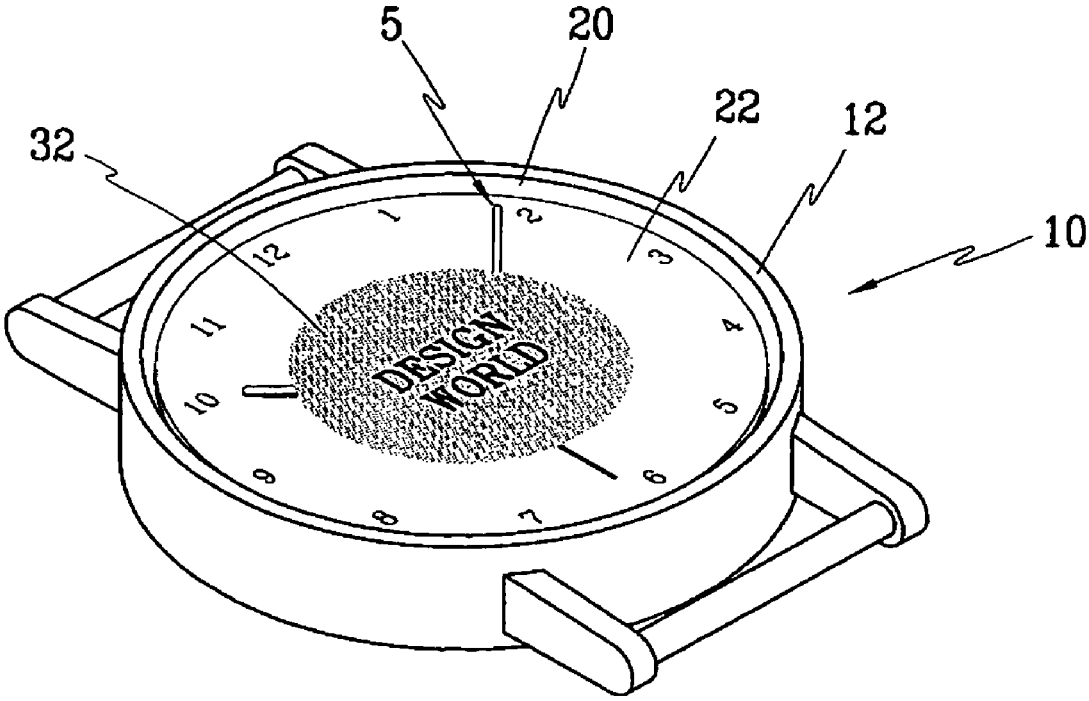
FIG. 2 is a perspective view for illustrating a watch assembly according to a first embodiment of the present invention.

Preferred embodiments of the present invention will be described in more detail hereinafter in conjunction with the accompanying drawings.

As described in FIGS. 2 to 5, a watch assembly 10 according to a first embodiment of the present invention comprises a case 12, a movement 14 provided at an inner portion of the case 12, hands 15 coupled to the movement 14 for indicating hours, minutes, and seconds, a watch-glass 20 provided in the case 12 and arranged above the hands 15, and a dial 28 provided at the watch-glass 20 and having characters 30 representing time such that the hands 15 indicate the characters 30 to thereby display the time.

In the watch assembly 10, the case 12 forms a concave portion 24 at an inner part thereof.

Also, the movement 14 is provided at the concave portion 24 of the case 12, and the movement 14 rotates the hands 15 at predetermined speeds. The movement 14 is a type of gear drive comprised of a plurality of gears, like a general movement.

In addition, a cover 22 is provided to the upper part of the concave portion 24 of the case 12 so as to cover the movement 14.

Designs or characters can be displayed on the surface of the dial 28, thereby giving it a refined appearance.

Also, the hands 15 include an hour hand 16, a minute hand 17, and a second hand 18. Further, since the hands 15 are coupled to the movement 14, while the movement 14 is driving, the hands 15 rotate to represent the time.

The hour hand 16, the minute hand 17, and the second hand 18 have different widths so they can be distinguished from each other.

Of course, it is also possible for the hour hand 16, the minute hand 17, and the second hand 18 to have different lengths so as to distinguish them.

The watch-glass 20 is provided at an upper portion of the case 12, and it is preferably made of a transparent material or an opaque material. That is, the watch-glass 20 is made of glass, resin, sapphire, crystal, or jewel. Therefore, the user is able to look through the watch-glass 20 at the hands 15 provided at an inner portion of the watch assembly 10 and determine the time.

The surface of the watch-glass 20 has either a simple plane or a predetermined shape that is manufactured by carving.

The dial 28 is integrally provided at the watch-glass 20 so as to represent the time. The dial 28 includes characters displayed by a film, representing the time, and the film is provided either at an inner side of the watch-glass 20 or at an outer side of the watch-glass 20.

Figure 3:
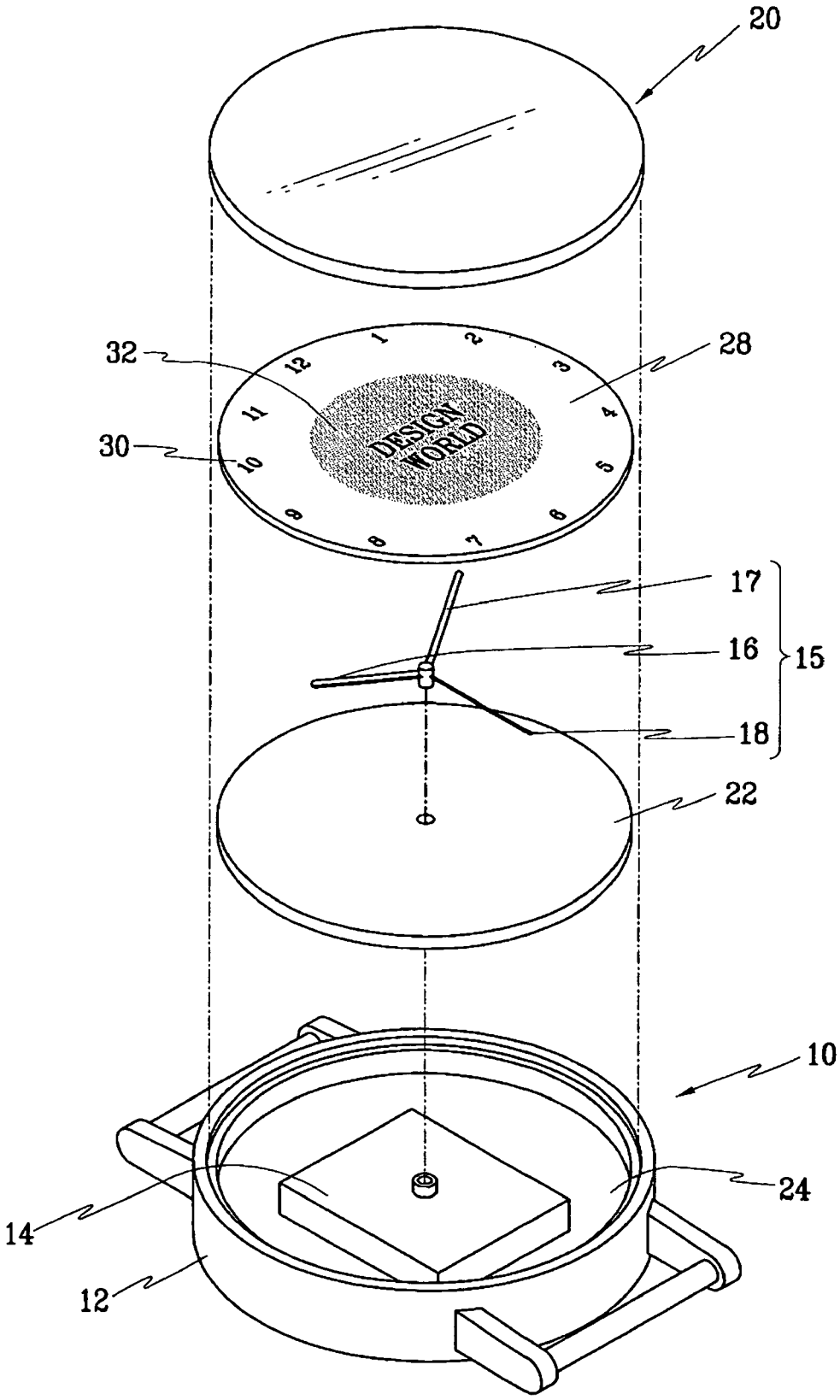
FIG. 3 is a partial perspective view of the watch assembly of FIG. 2.
Figure 4:
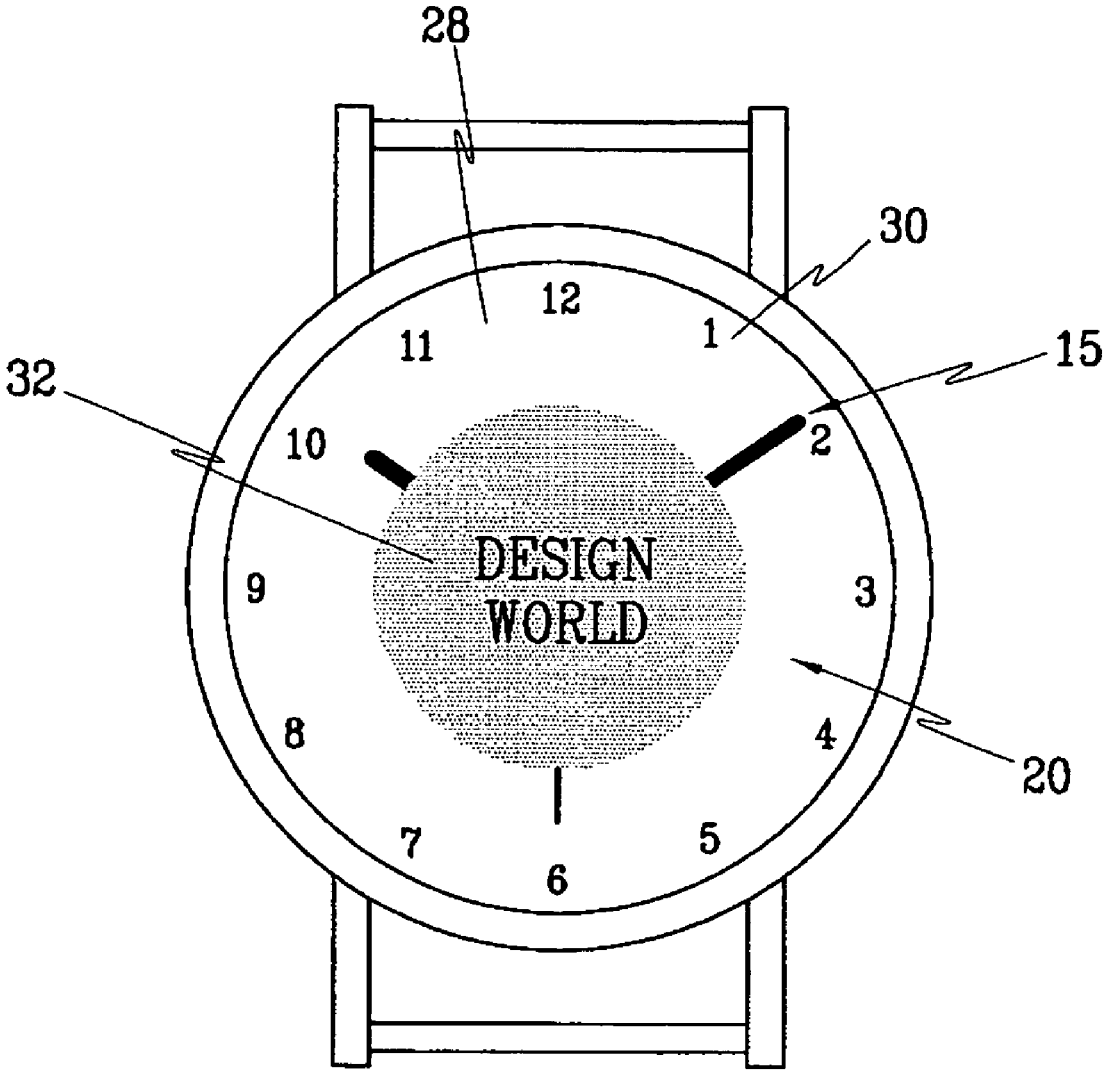
FIG. 4 is a plan view of the watch assembly of FIG. 2.
Figure 5:
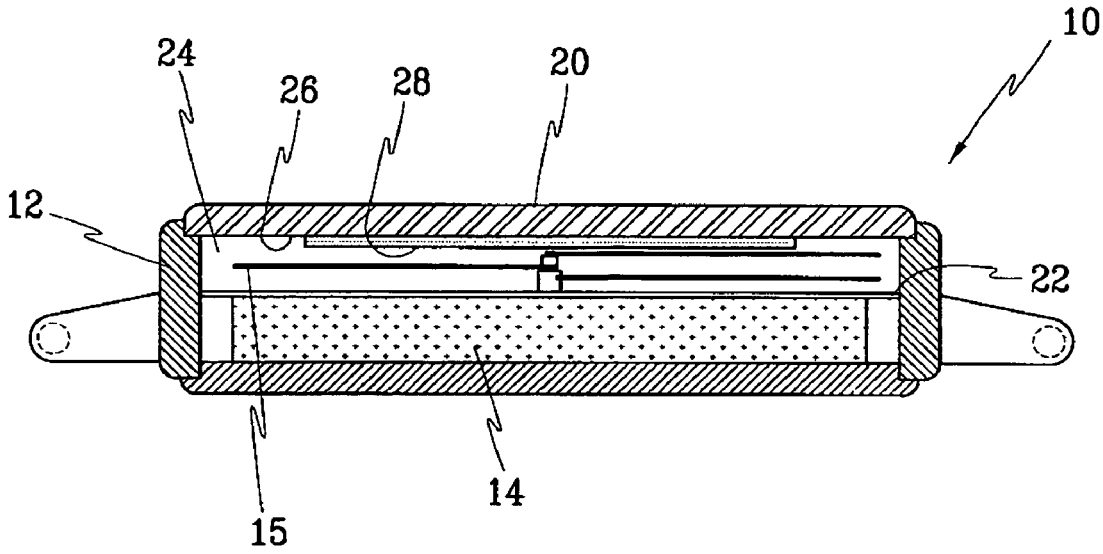
FIG. 5 is a sectional view for illustrating an inner side of the watch assembly of FIG. 2.

In the dial 28, as shown in FIGS. 3 to 5, the dial 28 has letters or numbers representing the time along an edge portion thereof as does a general dial.

Furthermore, the dial 28 has characters at the edge portion thereof, and the dial 28 has an opaque portion 32 at the central portion thereof. The design, characters, or indexes can be displayed on the opaque portion 32 of the dial 28.

Therefore, since the hands 15 are covered by the opaque portion 32 of the dial 28, the end portions of the hands 15 may be seen at an outer perimeter of the opaque portion 32, thereby indicating the characters on the edge portion of the dial 28.

Since the picture or letters can be displayed on the opaque portion 32, it is possible to realize the refined appearance by the picture or letters. That is, in the conventional art, since the dial is placed below the hands, the characters or design displayed on the dial are covered by the hands so as to prevent them from being fully observed.

In the present invention, since the dial 28 is integrally provided at a lower surface 26 of the watch-glass 20, the dial 28 is placed above the hands 15 so that the letters or design can be seen from the outer side of the watch-glass 20. Therefore, since various designs including photographic portraits, natural photographs, artistic photographs, sketches and the like, or characters or indexes can be displayed on the opaque portion 32, it is possible to display a refined design.

Although it has been described that the design, characters, and indexes representing the time can be displayed on the opaque portion of the dial, it is to be understood that the invention is not limited to the disclosed embodiments.

That is, it is possible that the design or characters are displayed on the opaque portion 32 of the dial 28, and the indexes representing the time are displayed on the cover 22.

Or, it is possible for the indexes representing the time to be omitted and the design or characters to be displayed on the opaque portion 32 of the dial 28.

It is possible for the designs or characters to be produced by various printing processes. Examples thereof include a conventional transcription printing process, an off-set printing process, and a screen printing process. The transcription printing process is a printing process in which images printed on paper are transcribed on a film, ceramics, glass, metal, plastic, and the like.

The off-set printing process is a kind of plan printing process. Generally, the off-set printing process is a printing process in which a printing plate is fastened to a rotating cylinder and carries an inked positive image, it transfers this image to the surface of a rubber-covered rotating cylinder, and then this cylinder transfers it to the paper.

Generally, the screen printing process is a printing process in which ink is forced through a design-bearing screen made of silk or other material onto the substrate being printed.

In the above, even though the dial 28 is printed on the film and adhered to the lower surface 26 of the watch-glass 20, it is possible for the dial 28 to be directly formed on the watch-glass 20.

That is, the characters representing time can be directly produced on the surface of the watch-glass 20 with an optical device such as a laser, a sculpture device, and the like. Of course, the dial 28 can also be directly printed on the surface of the watch-glass 20.

In addition, the characters can be formed by a plating process. That is, the characters are displayed on the surface of the watch-glass 20, and a plating solution is sprayed at the upper portion of the characters so as to form the characters.

In the case the watch-glass 20 is made of a resin, the dial 28 can be made by an injection molding process while the watch-glass 20 is injected.

As described above, it is possible to form the dial 28 on the watch-glass 20 by various processes. Further, the dial 28 can be selectively formed at the inner side or the outer side of the watch-glass 20. And, the dial 28 can be made with a metallic layer or a nonmetallic layer so as to be attached to an inner portion or an outer portion of the watch-glass 20.

Figure 6:
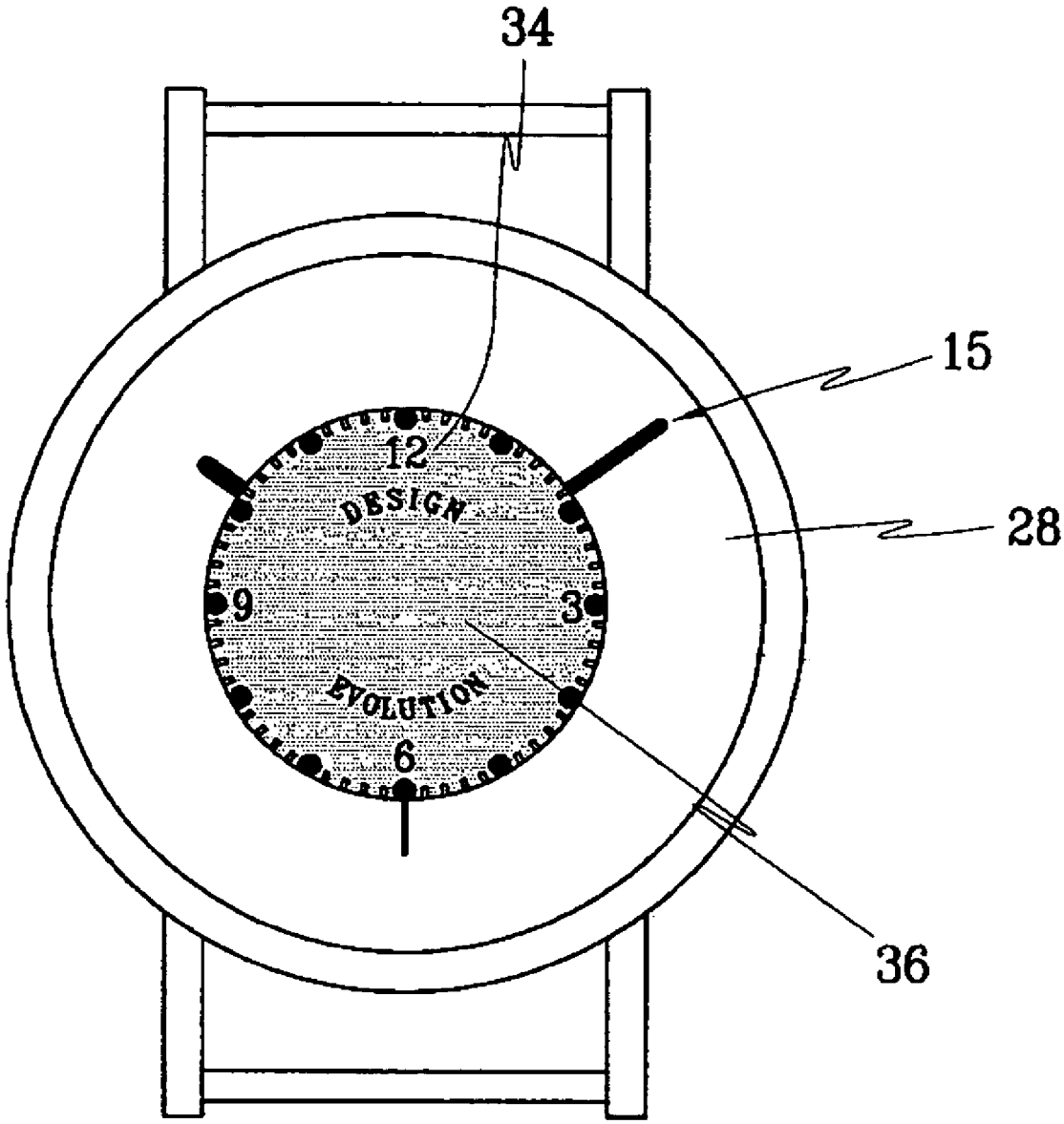
FIG. 6 is a plan view of a dial of a watch assembly according to a second embodiment of the present invention of FIG. 4.

As shown in FIG. 6, as another preferred embodiment, the characters can be formed at an edge of the opaque portion 36. That is, the characters 34 and indexes representing time are arranged at an edge portion of the opaque portion 36 along the circumferential direction.

In this case, since the central portion of the dial 28 is opaque, the central portions of the hands 15 are overlapped by the opaque portion 36 so that the end portions of the hands 15 can be seen. The end portions of the hands 15 are arranged to extend from an outer periphery of the opaque portion 36. Therefore, the hands 15 indicate the characters 34 of the dial 28 from the outer side of the opaque portion 36, thereby displaying the time.

Although this invention has been described above in connection with a wristwatch, it is to be understood that the invention is not limited to the disclosed embodiments.

Figure 7:
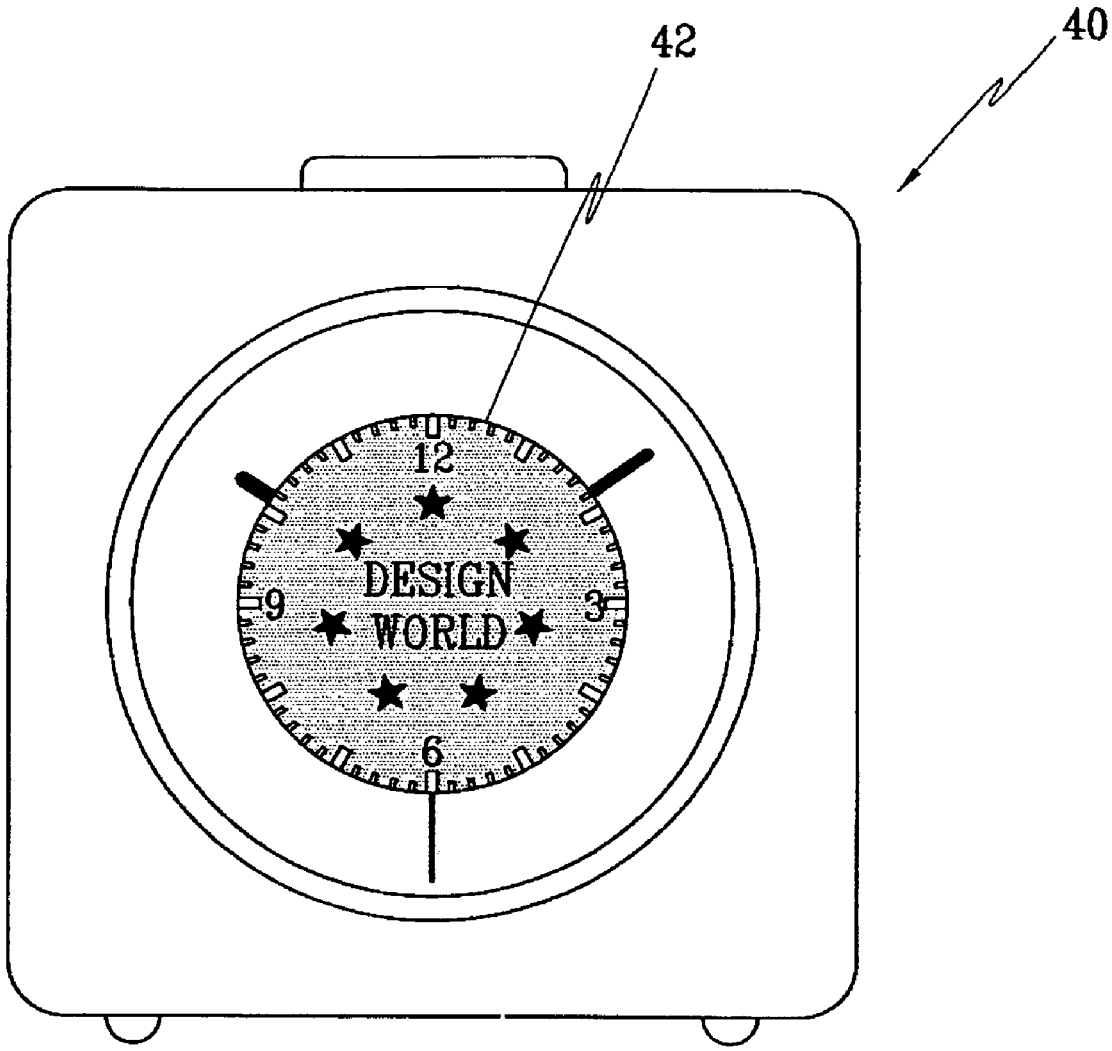
FIG. 7 is a view for illustrating a watch assembly according to a third embodiment of the present invention.
Figure 8:
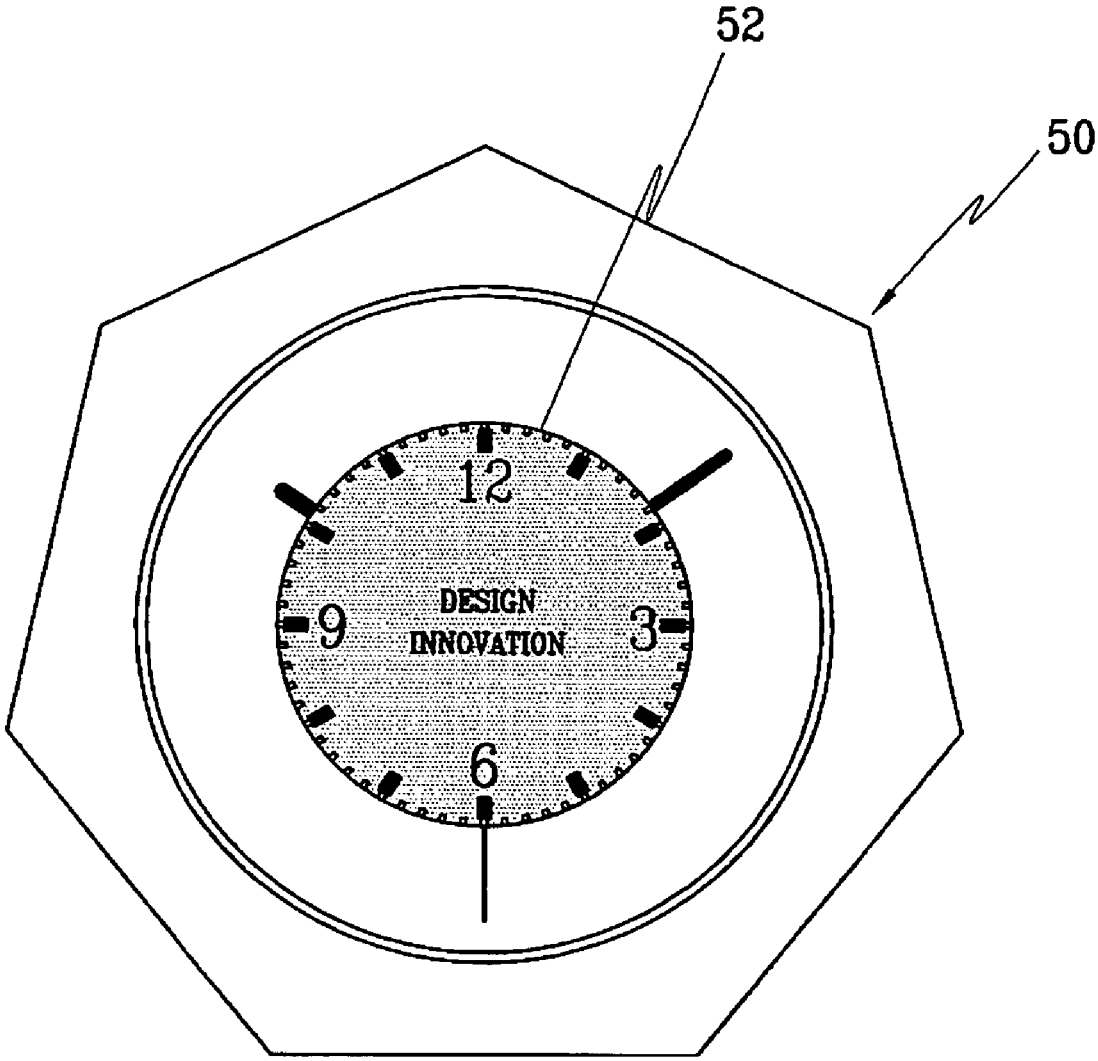
FIG. 8 is a view for illustrating a watch assembly according to a fourth embodiment of the present invention.

That is, as shown in FIG. 7, the dial 42 according to a preferred embodiment of the present invention can be applied to a table clock 40, and as shown in FIG. 8, the dial 52 according to a preferred embodiment of the present invention can be applied to a wall tapestry clock 50.

As described above, the watch assembly according to a present invention includes a dial which is integrally provided at the watch-glass, and various designs including photographic portraits, natural photographs, artistic photographs, sketches, and the like or characters are displayed on the dial, thereby embodying an appearance having a refined design. The designs or characters can be formed by various printing processes or manufacturing processes.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A watch assembly comprising:

a case;

a movement provided at an inner side of the case;

hands coupled to the movement, for indicating hours, minutes, and seconds; and a watch-glass provided at the case, the watch-glass having a dial so that the hands indicate characters, thereby displaying the time.

2. The watch assembly as claimed in claim 1, wherein the hands includes an hour hand, a minute hand, and a second hand, and the hour hand, the minute hand, and the second hand have different widths from each other.

3. The watch assembly as claimed in claim 1, wherein the watch-glass is made of transparent glass, resin, sapphire, or crystal.

4. The watch assembly as claimed in claim 1, wherein the dial has characters representing time at an edge portion thereof, and the dial has an opaque portion at a central portion thereof so that the end portions of the hands may seen at an outer edge of the opaque portion.

5. The watch assembly as claimed in claim 1, wherein the dial has an opaque portion displaying a design having characters and indexes displayed at an outer edge of the opaque portion representing time, so that the end portion of the hands may be seen at an outer portion of the opaque portion.

6. The watch assembly as claimed in claim 1, wherein the design of the opaque portion includes photographic portraits, natural photographs, artistic photographs, and sketches.

7. The watch assembly as claimed in claim 1, wherein the dial is formed on the watch-glass by means of a carving or laser process.

8. The watch assembly as claimed in claim 1, wherein the dial is formed while the watch-glass is being injected.

9. The watch assembly as claimed in claim 1, wherein the dial is formed on a film so as to be attached to an inner portion or an outer portion of the watch-glass.

10. The watch assembly as claimed in claim 1, wherein the dial is formed on the watch-glass or the film by a transcription process.

11. The watch assembly as claimed in claim 1, wherein the dial is formed on the watch-glass or the film by a screen printing process.

12. The watch assembly as claimed in claim 1, wherein the dial is formed on the watch-glass or the film by an off-set printing process.

13. A watch assembly comprising:

a case;

a movement provided at an inner portion of the case;

hands coupled to the movement, for indicating hours, minutes, and seconds;

a watch-glass provided at the case and arranged above the hands; and a dial provided at the watch-glass and having characters representing time so that the hands indicate the characters, thereby displaying the time.

14. The watch assembly as claimed in claim 13, wherein the dial is made of a metallic material or a nonmetallic material so as to be attached to an inner portion or an outer portion of the watch-glass.

15. The watch assembly as claimed in claim 13, wherein the hands includes an hour hand, a minute hand, and a second hand, and the hour hand, the minute hand, and the second hand have different widths from each other.

16. The watch assembly as claimed in claim 13, wherein the watch-glass is made of transparent glass, resin, sapphire, or crystal.

17. The watch assembly as claimed in claim 13, wherein the dial has characters representing time at an edge portion thereof, and the dial has an opaque portion at a central portion thereof so that the end portions of the hands may seen at an outer edge of the opaque portion.

18. The watch assembly as claimed in claim 13, wherein the dial has an opaque portion displaying a design having characters and indexes displayed at an outer edge of the opaque portion representing time, so that the end portion of the hands may be seen at an outer portion of the opaque portion.

19. The watch assembly as claimed in claim 13, wherein the design of the opaque portion includes photographic portraits, natural photographs, artistic photographs, and sketches.

20. The watch assembly as claimed in claim 13, wherein the dial is formed on the watch-glass by means of a carving or laser process.

21. The watch assembly as claimed in claim 13, wherein the dial is formed while the watch-glass is being injected.

22. The watch assembly as claimed in claim 13, wherein the dial is formed on a film so as to be attached to an inner portion or an outer portion of the watch-glass.

23. The watch assembly as claimed in claim 13, wherein the dial is formed on the watch-glass or the film by a transcription process.

24. The watch assembly as claimed in claim 13, wherein the dial is formed on the watch-glass or the film by a screen printing process.

25. The watch assembly as claimed in claim 13, wherein the dial is formed on the watch-glass or the film by an off-set printing process.

26. A watch assembly comprising:

a case;

a movement provided at an inner portion of the case;

a cover provided on the upper part of the concave portion of the case so as to cover the movement;

hands coupled to the movement, for indicating hours, minutes, and seconds;

a watch-glass provided at the case and arranged above the hands; and a dial provided at the watch-glass and having characters and an opaque portion at a central portion thereof.

27. The watch assembly as claimed in claim 26, wherein the cover has indexes thereon for representing time so that the hands indicate the indexes, thereby displaying the time.

28. The watch assembly as claimed in claim 26, wherein the design of the opaque portion includes photographic portraits, natural photographs, artistic photographs, and sketches.

29. The watch assembly as claimed in claim 26, wherein the dial is formed on the watch-glass by means of a carving or laser process.

30. The watch assembly as claimed in claim 26, wherein the dial is formed while the watch-glass is being injected.

31. The watch assembly as claimed in claim 26, wherein the dial is formed on a film so as to be attached to an inner portion or an outer portion of the watch-glass.

32. The watch assembly as claimed in claim 26, wherein the dial is formed on the watch-glass or the film by a transcription process.

33. The watch assembly as claimed in claim 26, wherein the dial is formed on the watch-glass or the film by a screen printing process.

34. The watch assembly as claimed in claim 26, wherein the dial is formed on the watch-glass or the film by an off-set printing process.

* * * * *

UNITED STATES PATENT AND TRADEMARK OFFICE

CERTIFICATE OF CORRECTION

PATENT NO. : 7,347,619 B2
APPLICATION NO. : 11/371422
DATED : March 25, 2008
INVENTOR(S) : Lee It is certified that error appears in the above-identified patent and that said Letters Patent is hereby corrected as shown below:

Column 4,

Lines 66 & 67, “may seen” should read --may be seen--.

Signed and Sealed this

First Day of July, 2008

JON W. DUDAS
*Director of the United States Patent and Trademark Office*